US005298955A

United States Patent [19]

Bean et al.

[11] Patent Number: 5,298,955

[45] Date of Patent: Mar. 29, 1994

[54] BLADE CLEANABLE CORONA POROUS TRANSFER DEVICE

[75] Inventors: Lloyd F. Bean; Thomas R. Race, both of Rochester, N.Y.

[73] Assignee: Xerox Corporation, Stamford, Conn.

[21] Appl. No.: 38,363

[22] Filed: Mar. 29, 1993

[51] Int. Cl.[5] ..... G03G 15/16

[52] U.S. Cl. ..... 355/274; 355/271

[58] Field of Search ..... 355/274, 271, 276, 221

[56] References Cited

U.S. PATENT DOCUMENTS

| | | | |
|---|---|---|---|
| 3,811,670 | 5/1974 | Inoue | 271/80 |
| 3,850,519 | 11/1974 | Weikel, Jr. | 355/3 R |
| 4,060,320 | 11/1977 | Doi et al. | 355/3 R |
| 4,110,024 | 8/1978 | Gundlach | 355/3 TR |
| 4,171,157 | 10/1979 | Suzuki . | |
| 4,184,870 | 1/1980 | Suzuki . | |
| 4,190,348 | 2/1980 | Friday | 355/3 TR |
| 4,341,456 | 7/1982 | Iyer et al. | 355/3 TR |
| 4,351,601 | 9/1982 | Cormier et al. | 355/3 SH |
| 4,420,243 | 12/1983 | Baker et al. | 355/3 TR |
| 4,736,227 | 4/1988 | Till et al. . | |
| 4,739,362 | 4/1988 | Kau et al. | 355/3 TR |
| 4,849,784 | 7/1989 | Blanchet-Fincher | 355/274 |
| 4,947,214 | 8/1990 | Baxendell et al. | 355/274 |

*Primary Examiner*—R. L. Moses

[57] ABSTRACT

An apparatus which transfers a developed image from a photoconductive surface to a copy sheet. The apparatus includes a corona generating member arranged to charge the copy sheet. This establishes a transfer field that is effective to attract the developed image from the photoconductive surface of the copy sheet. A rotatable helical element surrounds the corona generating member and is positional to contact the copy sheet and press it into contact with at least the developed image on the photoconductive surface to eliminate transfer deletions that are caused by non-contact between the photoconductive surface and a copy sheet during the transfer step.

32 Claims, 5 Drawing Sheets

BLADE CLEANABLE CORONA POROUS TRANSFER DEVICE

This invention relates generally to an electrophotographic printing machine, and more specifically concerns an apparatus for transferring a developed image from a photoconductive surface to a copy sheet.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy sheet. Heat is applied to the toner particles to permanently affix the powder image to the copy sheet.

High speed commercial printing machines of the foregoing type handle a wide range of differing weight copy sheets. The beam strength of the copy sheet is a function of the weight of the sheet. Heavier weight copy sheets have greater beam strength than lighter weight copy sheets. Inasmuch as the sheet conveying system of the printing machine handles a wide range of differing weight copy sheets, it is not unusual for the copy sheet to be wrinkled before it is transported to the processing station where the developed image is transferred to the copy sheet. The stack of copy sheets placed in the sheet feeder may be initially wrinkled, or the copy sheets may become wrinkled as they are fed from the stack to the transfer station. At the transfer station, the copy sheet adheres to the photoconductive member. In the event the copy sheet is wrinkled, it is not held in intimate contact with the photoconductive surface, but rather spaces occur between the developed image on the photoconductive surface and the copy sheet. In the electrostatic transfer of the toner powder image to the copy sheet, it is necessary for the copy sheet to be in uniform, intimate contact with the toner powder image developed on the photoconductive surface. Failure to do so results in variable transfer efficiency and, in the extreme, areas of low or no transfer resulting in image deletions. Clearly, an image deletion is very undesirable in that useful information and indicia are not reproduced on the copy sheet. Various methods have been used to minimize the incidence of image deletions. Hereinbefore, mechanical devices, such as rollers, have been used to press the copy sheet against the toner powder image on the photoconductive surface. For example, in the 9000 family of electrophotographic printing machines manufactured by the Xerox Corporation, an electrically biased transfer roll system is effective in substantially eliminating these image deletion. In other electrophotographic printing machines, such as the Model No. 1065, manufactured by the Xerox Corporation, the bend in the copy sheet as it enters the transfer station is precisely controlled. These and other types of devices illustrating the background of this technology are described in exemplary patents. U.S. Pat. No. 3,811,670 issued to Inoue in 1974 describes a flexible baffle attached to the wall of a corona generator pressing the transfer medium against the powder image formation member. U.S. Pat. No. 3,850,519 issued to Weikel, Jr. in 1974 describes a baffle having an elongated body pivotably mounted at one end on a pin, and an extended arm which projects between the shield of the corona generator and the photoreceptor surface. The upper surface of the baffle is arranged to engage the bottom surface of the copy sheet being forwarded into the transfer station so as to direct the copy sheet into contact with the photoreceptor. The extended arm of the baffle shields the region from the corona stream to assure that the sheet is well seated against the photoreceptor surface prior to being exposed to the corona stream. U.S. Pat. No. 4,190,348 issued to Friday in 1980 discloses an electrically biased transfer roller which presses the copy sheet into positive engagement with the surface of the photoreceptor. U.S. Pat. No. 4,110,024 issued to Gundlach in 1978 describes a corona pervious web and corona discharge electrodes. As the leading edge of the receiving sheet advances into the transfer zone, the corona discharge electrode is energized and imparts a substantially uniform charge to the backside of the receiving sheet. The corona pervious web insures that the receiving sheet is in substantially continuous contact with the photoreceptor surface.

The following disclosures appear to be relevant:

U.S. Pat. No. 4,060,320
Patentee: Doi et al.
Issued: Nov. 29, 1977

U.S. Pat. No. 4,341,456
Patentee: Ilyer et al.
Issued: Jul. 27, 1982

U.S. Pat. No. 4,351,601
Patentee: Cormier et al.
Issued: Sep. 28, 1982

U.S. Pat. No. 4,420,243
Patentee: Baker et al.
Issued: Dec. 13, 1983

U.S. Pat. No. 4,739,362
Patentee: Kau et al.
Issued: Apr. 19, 1988

U.S. Pat. No. 4,947,214
Patentee: Baxendell et al.
Issued: Aug. 7, 1990

The relevant portions of the foregoing patents may be summarized briefly as follows:

U.S. Pat. No. 4,060,320 describes a paper separating device that uses flexible elastic polyester film as blade members. The edge of the blade contains Nylon fibers to reduce contact with the photoreceptor surface and subsequent damage thereto.

U.S. Pat. No. 4,341,456 discloses a transfer system using a flexible brush having conductive bristles. The leading edge of the copy sheet will deflect the bristles causing them to bend and contact the back side of the paper as the paper is moved into contact with the toner image on the photoreceptor. A voltage source electrically biases the brush bristles. As the copy sheet continues to move toward the photoreceptor, a light sensing device detects the trailing edge of the copy sheet. A signal is sent to a delay circuit and a delayed signal sent to a solenoid to cause the solenoid to be momentarily actuated to move the bristles out of contact with the back side of the copy sheet immediately before the trailing edge of the copy sheet moves out of contact with the photoreceptor. This prevents the brush bristles from contacting the photoreceptor and collecting toner which would be passed onto subsequent copy sheets.

U.S. Pat. No. 4,351,601 describes a sheet hold down arrangement having a support member that exerts a force on the paper holding it onto the photoreceptor surface.

U.S. Pat. No. 4,420,243 discloses a hold down finger that engages the back side of the copy sheet as it passes through the transfer station to ensure that as nearly complete a copy as is possible is made.

U.S. Pat. No. 4,739,362 describes an upper and lower baffle though which a sheet passes. The upper baffle is mounted pivotably and normally is biased by its own weight against the lower baffle. The weight of the upper baffle serves to aid in imparting a bow corresponding to the curvature of the end of the lower baffle by biasing the sheets against the flanged portion and the curved sheet supporting surface as the sheets pass between the two baffle members. This reduces the sheet spring force required to smooth the sheet and permits better contact between the trailing edge of the sheet and the photoreceptor.

U.S. Pat. No. 4,947,214 is directed to a transfer apparatus in which a blade is moved from a non-operative position spaced from a copy sheet to an operative position in contact with a copy sheet in order to press the copy sheet against a photoconductive surface in order to eliminate space between the copy sheet and the photoconductive surface during transfer.

In accordance with one aspect of the present invention, there is provided a device for transferring a developed image from a photoconductive surface to a copy sheet. The device includes means for charging the copy sheet to attract the developed image from the photoconductive surface to the copy sheet, means adapted to ride on the photoconductive surface and the back of the copy sheet to ensure good contact between the two and thereby eliminate deletions during transfer, and means for cleaning toner from the means adapted to ride on the photoconductive surface and the back of the copy sheet.

In another aspect of the features of the present invention, there is provided an electrophotographic printing machine of the type in which a a developed image is transferred from a photoconductive surface to a copy sheet at a transfer station. The improved printing machine includes a charging element, positioned at the transfer station, for charging the copy sheet to establish a transfer field that is effective to attract the developed image from the photoconductive surface to the copy sheet. A rotating pressing member presses the copy sheet into contact with at least the developed image on the photoconductive surface in the transfer station. A blade cleans toner from the pressing member.

The present invention is also concerned with a method of transferring a developed image from a photoconductive surface to a copy sheet at a transfer station. The method of transfer includes the steps of establishing, at the transfer station, a transfer field that is effective to attract the developed image from the photoconductive surface to the copy sheet. A pressing member is positioned to contact the copy sheet and press it against the photoconductive surface in order to ensure that at least the developed image is in contact with the copy sheet and that no image deletion takes place. A flexible cleaning blade is positioned to clean toner from the pressing member.

Other aspects of the present invention will become apparent as the following description proceeds and upon reference to the drawings, in which.

While the present invention will hereinafter be described in connection with a preferred embodiment and method of use, it will be understood that it is not intended to limit the invention to that embodiment or method of use. On the contrary, it is intended to cover all alternatives, modifications, and equivalents, as may be included within the spirit and scope of the invention as defined by the appended claims.

Figure 1:
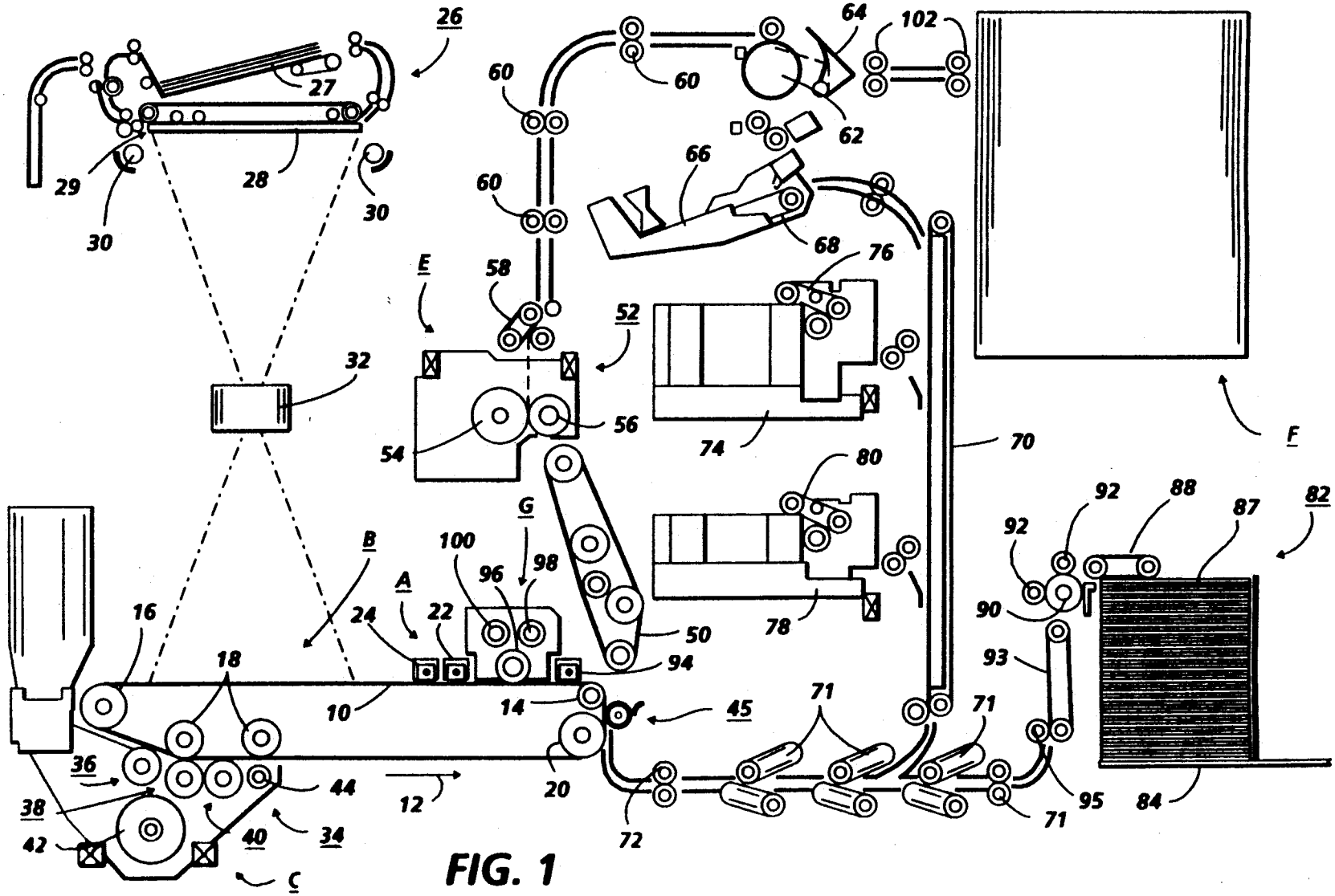
FIG. 1 is a schematic elevational view depicting an illustrative electrophotographic printing machine incorporating the transfer device of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of electrostatographic printing machines and is not specifically limited in its application to the particular embodiment or method of use described herein.

Referring now to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of photoconductive belt 10 passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder, located below the tray, feeds the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses the light image of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

Figure 2:
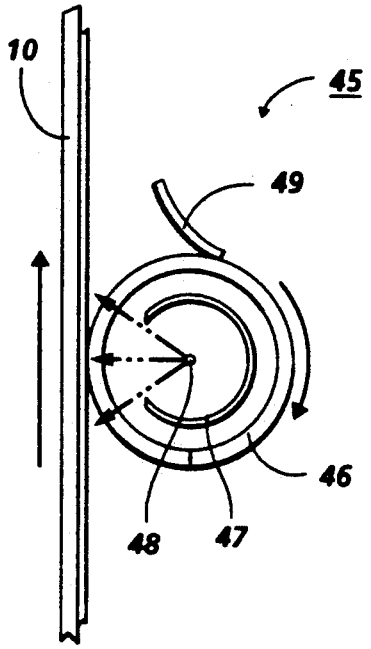
FIG. 2 is an elevational view showing the helical element and blade cleaner used in the FIG. 1 printing machine to press the copy sheet against the developed image in the transfer station.

At transfer station D, a copy sheet is moved into contact with the toner powder image. The copy sheet is advanced along the sheet path and is pressed into contact with the toner powder image on photoconductive surface 12 by the corona porous transfer device of the present invention, indicated generally by the reference numeral 45. Corona porous transfer device 45 presses the copy sheet into contact with the toner powder image at the transfer station ensuring that the copy sheet is substantially wrinklefree at the transfer station. The transfer device 45 charges the copy sheet to the proper magnitude and polarity so that the copy sheet is tacked to photoconductive belt 10 and the toner powder image attracted from the photoconductive belt to the copy sheet. In this way, the copy sheet moves with photoconductive belt 10, in the direction of arrow 12. Further details of this device will be described hereinafter with reference to FIG. 2.

After transfer, corona generator 48 charges the copy sheet to the opposite polarity to detack the copy sheet from belt 10. As belt 10 continues to move in the direction of arrow 12, the beam strength of the copy sheet causes the copy sheet to separate from belt 10. Conveyor 50, positioned to receive the copy sheet, advances it to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent is transferred to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding roller pairs 60 then advance the sheet to duplex turn roll 62. Duplex solenoid gate 64 guides the sheet to the finishing station F or to duplex tray 66. In the finishing station, the copy sheets are collected in sets with the copy sheets of each set being stapled or glued together. Alternatively, duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70, and rollers 72, for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. Secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator not shown. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

Invariably, after the copy sheet is separated from photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam correction, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 3:
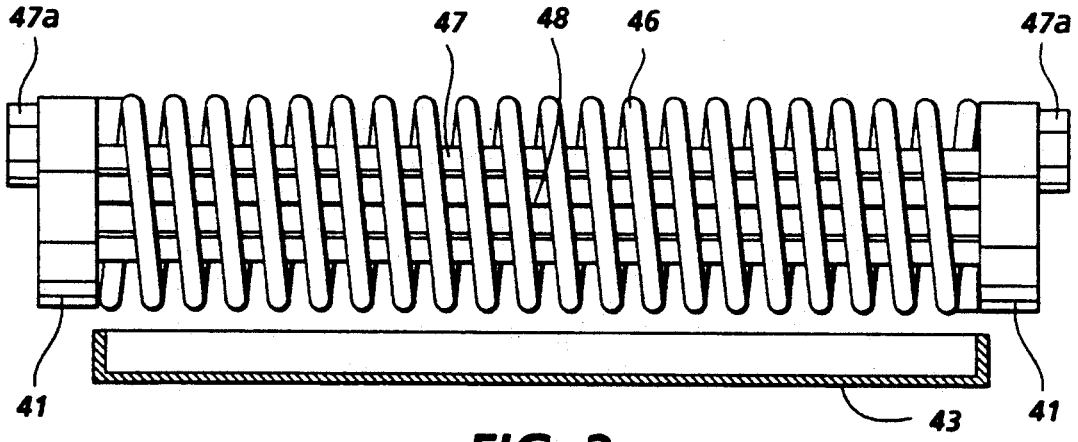
FIG. 3 is a partial front view illustrating the FIG. 2 helical element.
Figure 3A:
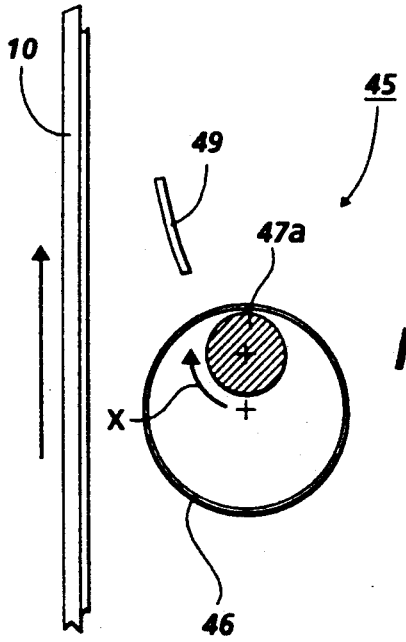
FIG. 3A is an elevational view showing the helical element in an non-operating position.
Figure 3B:
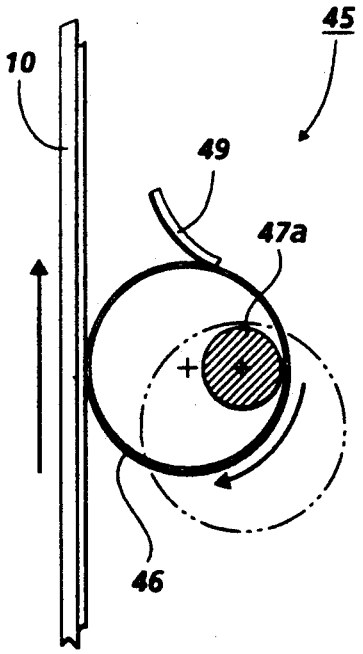
FIG. 3B is an elevational view showing the helical element in an operational position.

Referring now to FIGS. 2, 3, 3A and 3B, elevational views are shown further illustrating the features of the present invention. As shown thereat, blade cleanable corona porous transfer device 45 includes a rotatable round or circular helical element 46 that forces the copy sheet into contact with the image bearing photoconductive surface 10 and rotates at the same velocity as the photoconductive surface. The helical element 46 can be electrical insulating, conductive or a composite of the two. When it is conductive, it can be biased to enhance electrostatic transfer. For rigidity, helical element 46 can include circular rings affixed at right angles or elliptical rings that are affixed at an angle to rigidizing axial elements that result in a cylindrical shape. It is preferable that helical element 46 include an open area greater than 60% and a spatial frequency greater than ten turns/inch. A central nonrotating member 47 is positioned inside helical element 46 with a corona generating discharge member 48 located interiorly thereof. FIGS. 3A and 3B show an eccentric camming feature **47*a* that is incorporated into the ends of the central non-rotating member 47. When necessary, camming member 47*a* is rotated by conventional means in the direction of arrow X in FIG. 3A. This camming feature 47*a* enables horizontal movement of helical element via a limited rotation (e.g. ¼ turn) of the member 47. Initially there exists a non-operating position that locates the device 45 so that it is spaced from the photoconductive belt 10 (refer to FIG. 3A). To provide an operational position for the device 45, the central non-rotating member 47 is now rotated or pivoted clockwise a limited amount (e.g., ¼ turn) about the center of 47*a* forcing helical element 46 into contact with the photoconductive belt 10. A flexible edge cleaning blade 49 is stationary and cleans helical element 46 as the helical element rotates against the copy sheet. Corona discharge member 48 is adapted to emit ions against the back of the copy sheet 87 in order to attract the developed image from the photoconductive surface to the copy sheet. In this manner, image deletions are prevented during transfer due to helical element 46 riding on and rotating synchronously with photoconductive surface 10 while ensuring that copy sheet 87 is held flat against photoconductive surface 10**.

Figure 4:
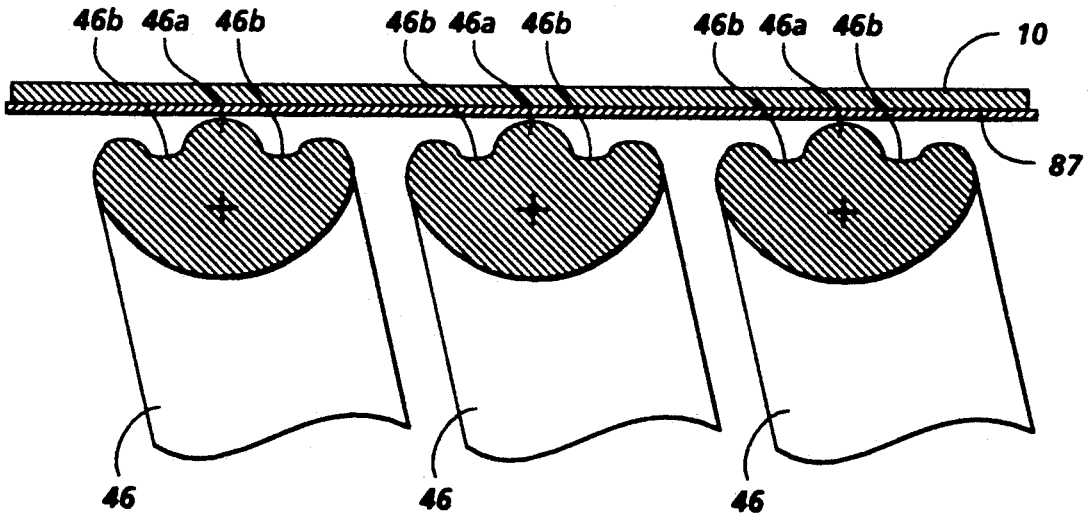
FIG. 4 is a partial cross-sectional plan view of the helical element of FIG. 2 including toner transporting grooves.

Alternatively, in FIG. 4, the toner which is picked up from photoconductive belt 10 when helical element 46 touches it is moved or augured from helical element portion 46a to toner transporting grooves 46b as the toner is held against helical element 46 by blade 49 which is conformable to force toner into the grooves. During successive rotations of the helix, the toner is moved to the ends of the helix and deposited in a conventional waste toner container 43.

Figure 5:
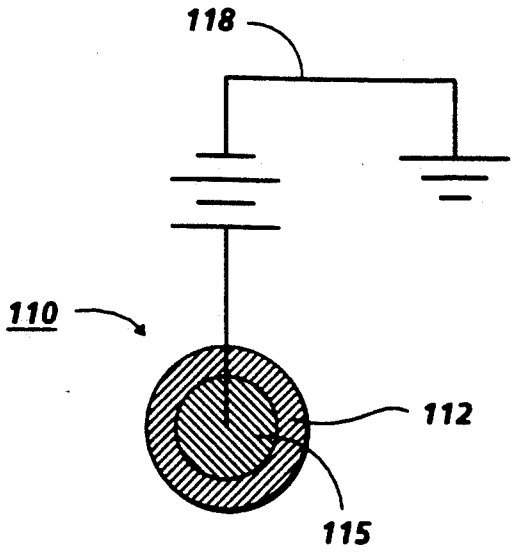
FIG. 5 is a partial cross-section side view of an alternative helical element in accordance with the present invention that includes a an insulating covering and a conductive core.
Figure 6:
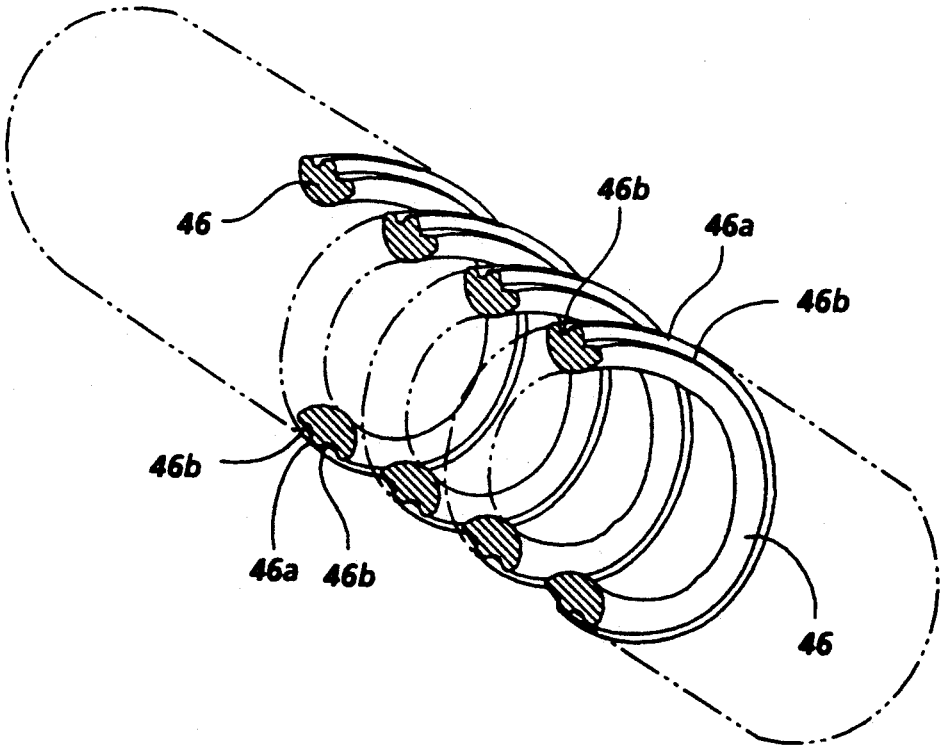
FIG. 6 is a partial perspective view of the helical element of FIG. 4.

FIGS. 5 and 6 are directed to a composite helix 110 consisting of a conductive helical core 115 and an insulating covering 112. The composite helix is biased by energy source 118. This insulating covering reduces the probability of arcing between the helix and the photoreceptor when a potential is applied to the helix by source 118. The covering can be made electrical leaky so that charges acquired on the surface of the dielectric covering during the transfer step with the helix in contact with the photoreceptor is dissipated during the period when the helix is not in contact with the photoreceptor. The electrically leaky insulating covering 112 can be Teflon-S and carbon black, for example, and helix 110 can be round, if desired.

Figure 7:
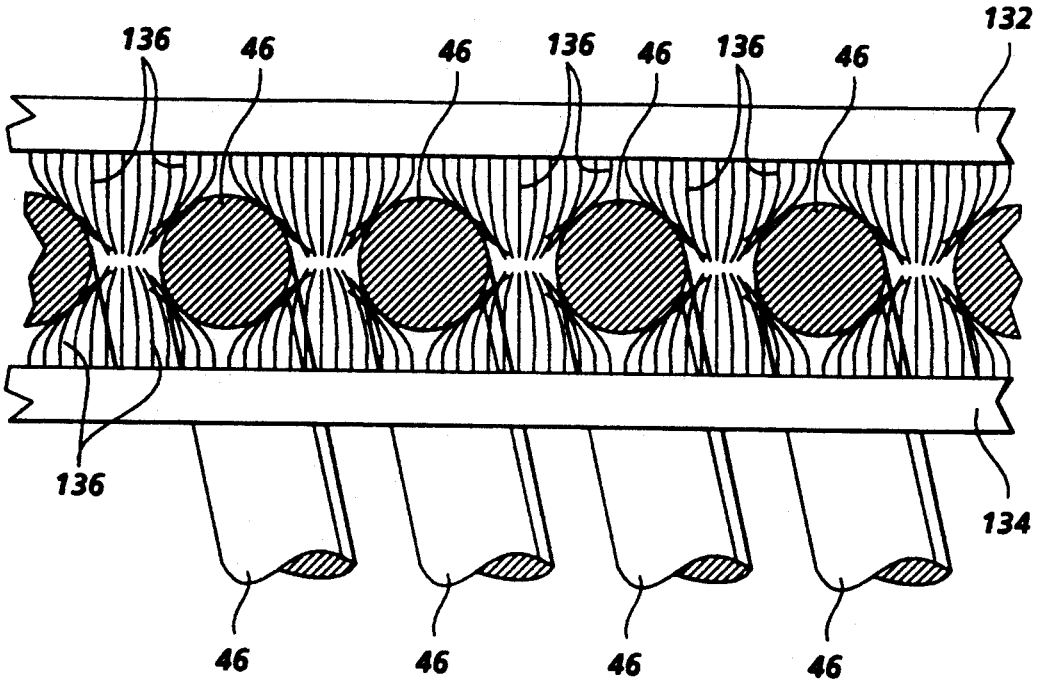
FIG. 7 is a partial cross-section of an alternative embodiment of this invention showing fibers for cleaning toner from the helical element of FIG. 2.
Figure 8:
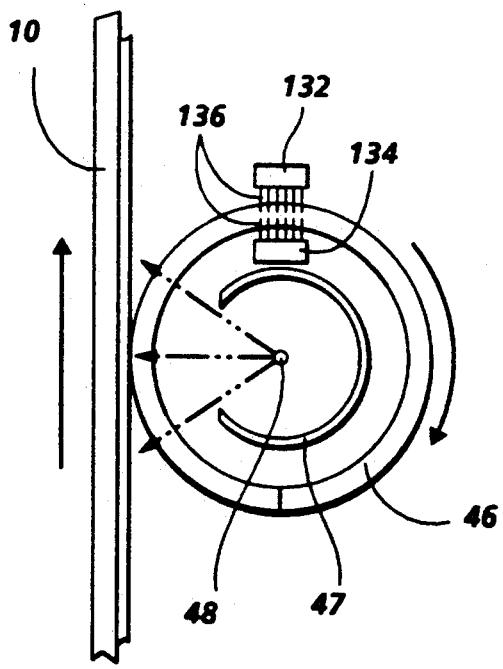
FIG. 8 is a side view of the apparatus of FIG. 7 showing the positioning of the cleaning fibers.

In place of blade 49, as shown in FIGS. 7 and 8, short bristles 136 which are mounted adjacent helical element 46 by supports 132 and 134 are used to clean toner from helical element 46. The short bristles form nips with the helical element and abraid against the outer surface of the helical element in order to clean it of toner after the helical element touches the surface of photoconductive belt 10 during transfer of an image from photoconductive belt 10 to a copy sheet 87.

In recapitulation, the transfer apparatus of the present invention includes a helical element pressing the copy sheet into intimate contact with the toner powder image developed on the photoconductive belt. This insures that the copy sheet is placed in intimate contact with the toner powder image on the photoconductive surface. A corona generating member inside the helical element generates a transfer field effective to transfer the toner powder image from the photoconductive belt to the copy sheet without deletions.

It is, therefore, evident that there has been provided, in accordance with the present invention, an apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for transferring a developed image from a moving photoconductive surface to a moving copy sheet, including:

means for charging the copy sheet to attract the developed image from the photoconductive surface to the copy sheet;

rotatable pressing means charging means for pressing the copy sheet into contact with at least the developed image on the photoconductive surface in the region of said charging means to substantially eliminate transfer deletions that are caused by non-contact between the photoconductive surface and the copy sheet; and flexible cleaning means positioned to clean said rotatable pressings means.

2. The apparatus of claim 1, wherein said pressing means is helical and surrounds said means for charging.

3. The apparatus of claim 2, wherein said rotatable pressing means is about 60% porous.

4. The apparatus of claim 3, wherein said rotatable pressing means is made of a conductive material.

5. The apparatus of claim 1, wherein said rotatable pressing means has a biased core covered by an insulating material.

6. The apparatus of claim 1, wherein said rotatable pressing means is made of a composite of conductive and non-conductive materials.

7. The apparatus of claim 6, wherein said conductive material is biased.

8. The apparatus of claim 7, wherein said composite of materials has a grooved outer surface.

9. The apparatus of claim 7, wherein said non-conductive material is electrically leaky.

10. The apparatus of claim 9, wherein said electrically leaky non-conductive material is made of Teflon-S and carbon black.

11. The apparatus of claim 1, wherein said rotatable pressing means has a grooved outer surface.

12. The apparatus of claim 1, including shield means partially surrounding said means for charging the copy sheet for focusing ions emitted by said means for charging the copy sheet toward the photoconductive surface.

13. The apparatus of claim 1, wherein said flexible cleaning means is a blade.

14. The apparatus of claim 1, wherein said flexible cleaning means is a plurality of bristles.

15. An electrophotographic printing machine of the type in which a developed image is transferred from a moving photoconductive surface to a moving copy sheet, wherein the improvement includes:

means for charging the copy sheet to attract the developed image from the photoconductive surface to the copy sheet;

rotatable pressing means for pressing the copy sheet into contact with at least the developed image on the photoconductive surface in the region of said charging means to substantially eliminate transfer deletions that are caused by non-contact between the photoconductive surface and the copy sheet; and flexible cleaning means positioned to clean said rotatable pressing means.

16. The electrophotographic printing machine of claim 15, wherein said pressing means is helical and surrounds said means for charging.

17. The electrophotographic printing machine of claim 15, wherein said rotatable pressing means is about 60% porous.

18. The electrophotographic printing machine of claim 17, wherein said rotatable pressing means is made of a conductive material.

19. The electrophotographic printing machine of claim 15, wherein said rotatable pressing means has a biased core covered by an insulating material.

20. The electrophotographic printing machine of claim 15, wherein said rotatable pressing means is a composite member having a conductive core and a dielectric covering material.

21. The electrophotographic printing machine of claim 20, wherein said conductive core is biased.

22. The electrophotographic printing machine of claim 20, wherein said composite member has a grooved outer surface adapted to transport toner to a toner sump.

23. The electrophotographic printing machine of claim 20, wherein said dielectric material is electrically leaky.

24. The electrophotographic printing machine of claim 23, wherein said electrically leaky dielectric material is made of Teflon-S and carbon black.

25. The electrophotographic printing machine of claim 15, wherein said rotatable pressing means has a grooved outer surface adapted to transport toner to a toner sump.

26. The apparatus of claim 15, including shield means partially surrounding said means for charging the copy sheet for focusing ions emitted by said means for charging the copy sheet toward the photoconductive surface.

27. A method of transferring a developed image from a moving photoconductive surface to a moving copy sheet, including the steps of:

charging the copy sheet to attract the developed image from the photoconductive surface to the copy sheet;

rotating rotatable pressing means and thereby press the copy sheet into contact with at least the developed image on the photoconductive surface in the region of said charging means to substantially eliminate transfer deletions that are caused by non-contact between the photoconductive surface and the copy sheet; and cleaning said rotatable pressing means with a flexible cleaning blade.

28. The method of claim 27, including the steps of pivoting said rotatable pressing means into contact with said photoconductive surface when copies are to be made and away from said photoconductive surface when no copies are being made.

29. An electrophotographic printing machine of the type in which a developed image is transferred from a moving photoconductive surface to a moving copy sheet, wherein the improvement includes:

a charging member for charging the copy sheet to attract the developed image from the photoconductive surface to the copy sheet; and helical rotatable pressing member surrounding said charging member for pressing the copy sheet into contact with at least the developed image on the photoconductive surface in the region of said charging member to substantially eliminate transfer deletions that are caused by non-contact between the photoconductive surface and the copy sheet.

30. The electrophotographic printing machine of claim 29, including flexible cleaning member positioned to clean said pressing member.

31. The electrophotographic printing machine of claim 30, wherein said flexible cleaning member is at least one brush.

32. The electrophotographic printing machine of claim 30, wherein said flexible cleaning member is a blade.

* * * * *